United States Patent [19]

Koller

[11] Patent Number: 4,620,589

[45] Date of Patent: Nov. 4, 1986

[54] DEVICE FOR CLEANING THE PIPES OF PIPE HEAT-EXCHANGERS

[76] Inventor: Josef Koller, Ziegeleiweg 26, 4006 Erkrath, Fed. Rep. of Germany

[21] Appl. No.: 695,972

[22] Filed: Jan. 29, 1985

[30] Foreign Application Priority Data

Jan. 31, 1984 [DE] Fed. Rep. of Germany ..... 3403198

[51] Int. Cl.[4] ..... F28G 1/12

[52] U.S. Cl. ..... 165/95; 15/3.51

[58] Field of Search ..... 165/95; 15/3.5, 3.51

[56] References Cited

U.S. PATENT DOCUMENTS

| | | | |
|---|---|---|---|
| 1,808,870 | 6/1931 | Strasburg | 15/3.5 |
| 3,841,397 | 10/1974 | Eimer | 165/95 |
| 3,919,732 | 11/1975 | Honma et al. | 165/95 X |
| 4,413,673 | 11/1983 | de Maigret | 165/95 |
| 4,566,533 | 1/1986 | Bochinski et al. | 165/95 |

FOREIGN PATENT DOCUMENTS

| | | | |
|---|---|---|---|
| 3112968 | 3/1981 | Fed. Rep. of Germany . | |
| 3138007 | 4/1983 | Fed. Rep. of Germany | 165/95 |
| 3222579 | 2/1984 | Fed. Rep. of Germany . | |
| 39754 | 10/1980 | Japan | 165/95 |

*Primary Examiner*—Sheldon J. Richter

*Attorney, Agent, or Firm*—Sprung Horn Kramer & Woods

[57] ABSTRACT

The invention relates to a device for cleaning the pipes of heat-exchangers by means of cleaning bodies, generally sponge balls. The removal and reintroduction of the cleaning bodies occurs with the aid of a device installed in the outlet pipe, which consists of a casing (1) with one or two screens (2) arranged within it. The screens (2) end on the downstream side at a pipe (3) with an opening (4). Inside this pipe (3) there is another pipe (5) with an opening (6) which preferably rotates continuously. The cleaning bodies (9) are collected in the inner pipe (5). A pressure water pipe (7) and a cleaning body outlet pipe (8) are connected to the outer pipe (3). When the inner pipe (5) is in the appropriate position, the cleaning bodies (9) are washed out of the inner pipe (5) by pressure water and introduced into the inlet pipe of the heat-exchanger via the cleaning body outlet pipe (8). A lock (11) is built into the cleaning body return pipe in order to introduce and remove the cleaning bodies (9).

7 Claims, 5 Drawing Figures

DEVICE FOR CLEANING THE PIPES OF PIPE HEAT-EXCHANGERS

The invention relates to a device for cleaning the pipes of heat exchangers by means of cleaning bodies, generally sponge balls. Traps are fitted to the outlet of such devices which separate the cleaning bodies from the medium, the cleaning bodies then being returned to the inlet by means of a pump. In addition a complex lock must be installed in the cleaning circulation system which permits the cleaning bodies to be introduced into or taken out of the circulation (e.g. DE OS No. 2451909).

These devices operate reliably, but their use is limited to larger heat-exchangers due to the high cost of the equipment. Furthermore, these cleaning systems have the disadvantage that the difference in pressure between the inlet and outlet pipes of the heat-exchanger can only reach a limited level as otherwise the cleaning bodies are destroyed in the return pump. It would be possible to arrange several pumps in series, but this would only mean high technical costs.

In another embodiment, in Japanese patent specification No. 10 49909, several chambers are formed in a cylindrical housing by means of rotating dividing walls. Practice has shown that due to the difference in pressure in the individual chambers, problems of sealing arise which may only be overcome by high manufacturing costs.

A further design is known in which a rotating valve is fitted to the separator, which is turned through 90° or 180° at certain intervals. An adjusting device with limit switches and an appropriate controller is needed for this. In addition a relatively expensive lock is required. Here too high technical costs are necessary which limit the use in small heat-exchangers.

The object of the invention is therefore to provide a simple device not having the above disadvantages which can be economically used in small heat-exchangers or in heat-exchangers having a large difference in pressure between the inlet and outlet.

The invention solves this problem in that one or two screens are fitted in a casing which end on the downstream side in a pipe with an opening. Inside this pipe there is another pipe with an opening which should preferably rotate continuously. A pressure water pipe is connected to the outer pipe, preferably at the side opposite the opening. Furthermore there is a exit pipe for the cleaning bodies which opens into the inlet pipe of the heat-exchanger. The screens can be pivoted. A lock is built into the cleaning body return pipe. The lock consists of an outer pipe and an inner screen pipe. Shut-off devices are provided at each end. The openings in the screen pipe casing can be of various shapes (borings, slits etc.) but the openings must be smaller than the cleaning bodies. In order to collect the cleaning bodies, a trap device is attached to the outlet which either totally or partially covers the cross section of the screen pipe according to the requirements. If only partially covered, the rest of the opening is correspondingly small to prevent the cleaning bodies from flowing through. The trap device can, for example, consist of a flap and one or more retractable pins. The connection between the outer pipe and the shut-off devices can be designed as a flange or as a quick-fitting pipe union.

The invention will be described below with the aid of a diagram which shows only one embodiment:

Schematically:

Figure 1:
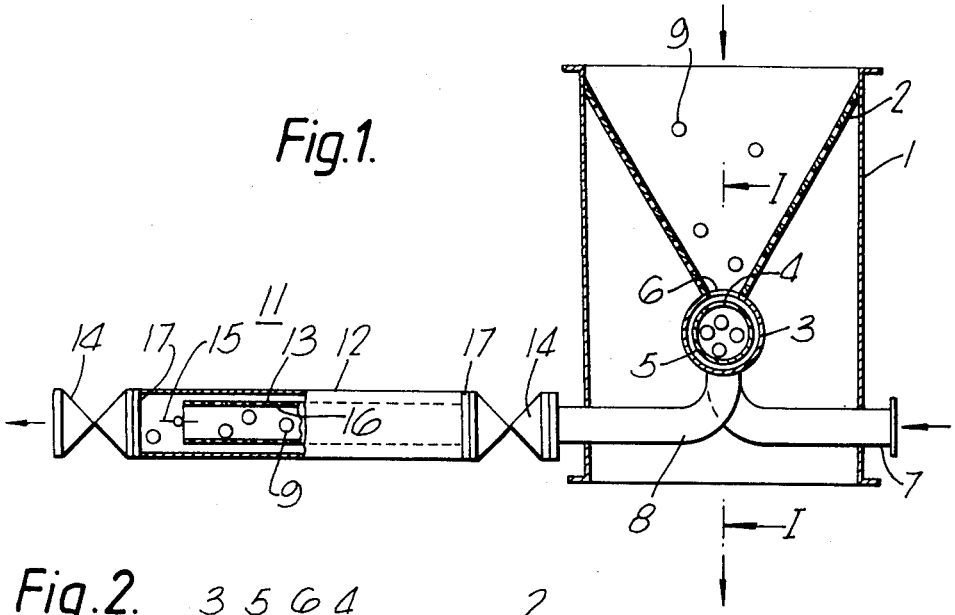
FIG. 1 shows a cross section through a device according to the invention.

FIG. 1 shows the device according to the invention in its operational position. It consists of a casing 1 with two screens 2 arranged to form a funnel ending, on the downstream side in a pipe 3 which has a longitudinal slit 4. Inside pipe 3 there is a further pipe 5 with a longitudinal slit 6. A pressure medium pipe 7 and a cleaning body outlet pipe 8, which opens into the inlet pipe (not shown) of the heat-exchanger, is connected to pipe 3 at the opposite side to the slit 4. In the preferred embodiment the pipe rotates continuously. FIG. 1 shows the position in which the two slits 4 and 6 coincide and the cleaning bodies 9 enter the interior of pipe 5. In this position pipe 5 closes off the two pipes 7 and 8. As pipe 4—which is driven by a motor 10 shown in FIGS. 2 and 3— rotates continuously, slit 6 is closed off first. No further cleaning bodies 9 can then enter the inside of the pipe 5. If pipe 5 rotates further slit 6 reaches a point above the connection openings of the two pipes 7 and 8. The medium, generally pressure water, now enters the inside of pipe 5 via the pressure water pipe 7 and carries the cleaning bodies 9 into the inlet pipe (not shown) of the heat-exchanger through the cleaning body outlet pipe 8. The cleaning bodies 9 are then forced through the heat-exchanger pipes by the medium and enter pipe 5 at the outlet side. These cycles "collecting the cleaning bodies" and "expelling the same" are repeated continuously. The lock 11 is connected to the cleaning body outlet pipe 8. The lock 11 can be built into the cleaning body return pipe at any point. The lock 11 consists of an outer pipe 12 and an inner screen pipe 13. Shut-off devices 14 are fitted at each end. A trap device 15 is fitted to the outlet side of screen pipe 13. When the trap device 15 is in the open position the medium and the cleaning bodies flow through the screen pipe 13. When the trap device 15 is closed, the section through the screen pipe 13 is partially or totally closed and the cleaning bodies 9 collect in screen pipe 13. The medium then flows through the opening 16 from inside to outside and leaves the lock via the annular space 21. When all the cleaning bodies 9 have been collected in the screen pipe 13, the two shut-off devices 14 are closed. By detaching the flange 17, pipe 12 and the screen pipe 13 can be removed and the cleaning bodies 9 introduced or taken out, without interrupting the operation of the heat-exchanger. The flanges 17 can be designed as quick-fitting pipe unions.

Figure 2:
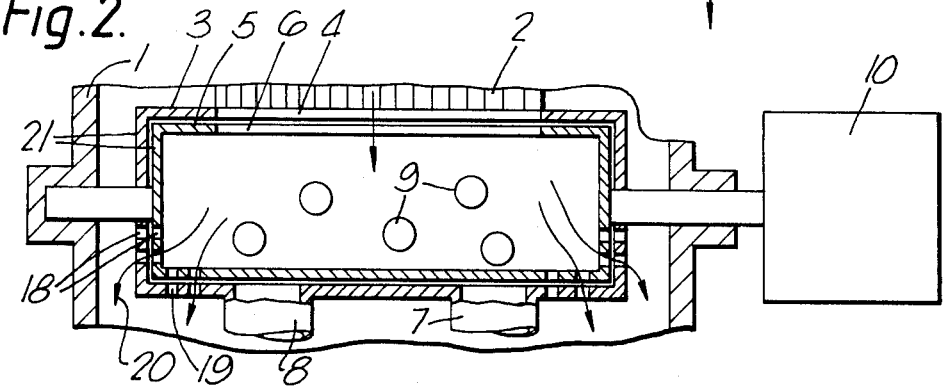
FIG. 2 shows the inner pipe in the trapping postion (section I—I)

FIG. 2 shows section I—I through pipes 3 and 5 in the position for collecting the cleaning bodies. The cleaning bodies 9 enter the inside of pipe 5 via slits 4 and 6. In order to facilitate the collection of the cleaning bodies 9 in pipe 5, half of the two faces (21) of pipes 3 and 5 are provided with openings 18 which are as far as possible congruent in the collecting position. A further embodiment involves closing off only half of the faces 21 of pipe 3. This results in a flow 20 which supports the collection of the cleaning bodies 9 in pipe body 5. According to requirements further openings 19 can be provided at the edges of pipes 3 and 5 around half the circumference.

Figure 3:
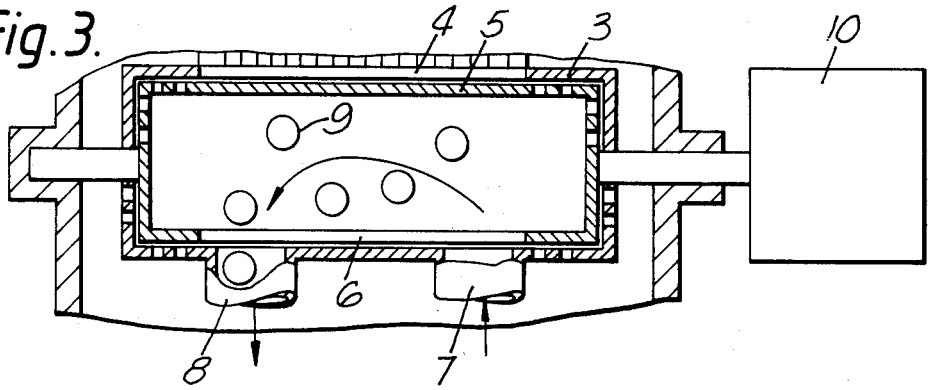
FIG. 3 shows the inner pipe in the position for expelling the invention with one or more screens, which end at a pipe wall on the downstream side.

FIG. 3 shows section I—I through pipes 3 and 5 in the position for expelling the cleaning bodies. The inner pipe is rotated by a further 180° in the shown position vis-a-vis FIG. 2. Slit 4 and the openings 18 and 19 are closed. Pipes 7 and 8 are open. The pressure water then enters the inside of pipe 5 via the pressure water pipe 7 and carries the cleaning bodies 9 into the inlet pipe (not shown) of the heat-exchanger via the cleaning body outlet pipe 8.

Figure 4:
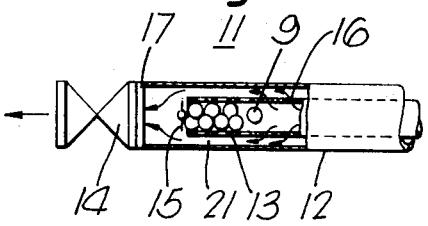
FIG. 4 shows the lock in the trapping position.

FIG. 4 shows the trap device 15 of the lock 11 in the collecting position. The cleaning bodies are collected in the screen pipe 13. The medium flows through the openings 16 of the screen pipe from inside to outside and reaches the outlet side via the annular space 21. After closing the shut-off fittings 14 and detaching the connection 17, the outer pipe 12 and the screen pipe 13 can be removed in order to take out the cleaning bodies 9 or to introduce new ones.

Figure 5:
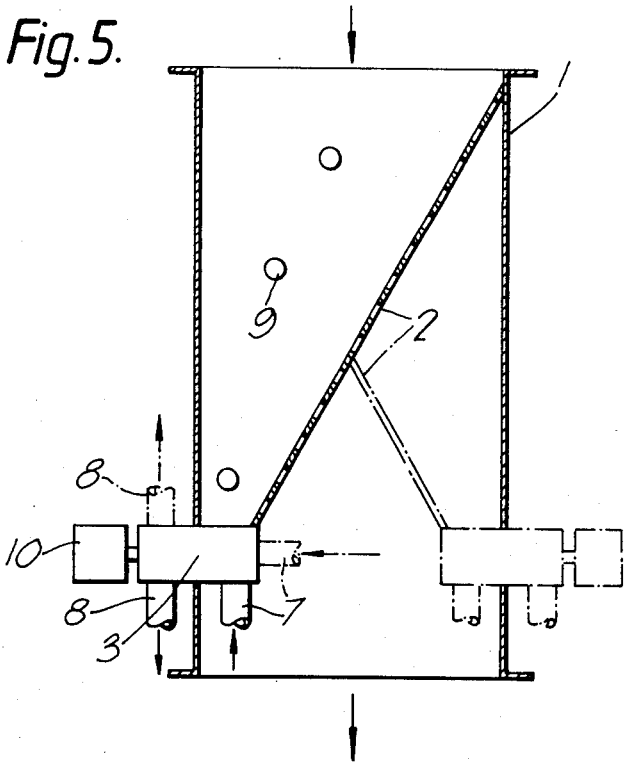
FIG. 5 shows a cross section through a device according to the invention with one or more screens, which end at a pipe wall on the downstream side.

FIG. 5 shows the device according to the invention with one or two screens 2 which end at the casing wall 1 on the downstream side. The two pipes 3 and 5 can, as shown, penetrate the casing wall 1 or be arranged in the casing 1. As is shown by the dotted line, the two connection pipes 7 and 8 can be connected in various ways.

What is claimed is:

1. In a device for cleaning the pipes of heat exchangers with cleaning bodies having means for removing and locking the cleaning bodies from the pipes, comprising at least one screen mounted in a casing and which ends downstream in a pipe having an opening, another member having an opening and rotationally mounted to the pipe, and a cleaning body exit line communicating with the pipe, the improvement wherein: the removing and locking means further comprises a lock connected to the cleaning body output line and comprising an outer pipe and an inner screen pipe, each fabricated from a piece of corresponding pipe material, shut-off devices, provided at the input and at the output end of the lock, trap means positioned at the output of the outer pipe and comprising a hinged flap and wherein the connection between the outer pipe and the shut-off device is releasable.

2. The device according to claim 1, at least at one side of the pipe and the member at the front sides are provided with at least one opening inside of a half circle.

3. The device according to claim 2, wherein at the opposite side of the openings in the pipe and member at least one opening is provided which extends to a maximum of a half circumference.

4. The device according to claim 1, further comprising a pressure medium connected to the pipe and wherein the pressure medium pipe and the cleaning body output line are provided opposite to the opening of the pipe.

5. The device according to claim 1, wherein the member is driven by a motor.

6. The device according to claim 5, wherein the member is constantly rotating on a continuous basis.

7. The device according to claim 1, comprising at least one screen mounted in a casing and which ends downstream in a pipe having an opening, another member having an opening and rotationally mounted to the pipe, and a cleaning body exit line communicating with the pipe, the improvement wherein: the removing and locking means further comprises a lock connected to the cleaning body output line and comprising an outer pipe and an inner screen pipe, each fabricated from a piece of corresponding pipe material, shut-off devices, provided at the input and at the output end of the lock, trap means positioned at the output of the outer pipe and comprising a by-pass line with shut-off device, which is a continuation of the outer pipe.

* * * * *